US011951544B2

(12) United States Patent
Kim et al.

(10) Patent No.: US 11,951,544 B2
(45) Date of Patent: Apr. 9, 2024

(54) METHOD FOR MANUFACTURING METAL ALLOY FOAM

(71) Applicant: LG CHEM, LTD., Seoul (KR)

(72) Inventors: So Jin Kim, Daejeon (KR); Dong Woo Yoo, Daejeon (KR); Jin Kyu Lee, Daejeon (KR)

(73) Assignee: LG Chem, LTD., Seoul (KR)

( * ) Notice: Subject to any disclaimer, the term of this patent is extended or adjusted under 35 U.S.C. 154(b) by 995 days.

(21) Appl. No.: 16/332,603

(22) PCT Filed: Oct. 12, 2017

(86) PCT No.: PCT/KR2017/011233
§ 371 (c)(1),
(2) Date: Mar. 12, 2019

(87) PCT Pub. No.: WO2018/070795
PCT Pub. Date: Apr. 19, 2018

(65) Prior Publication Data

US 2021/0276090 A1 Sep. 9, 2021

(30) Foreign Application Priority Data

Oct. 14, 2016 (KR) ..... 10-2016-0133353

(51) Int. Cl.
*B22F 3/11* (2006.01)
*B22F 3/105* (2006.01)
*C22C 1/08* (2006.01)

(52) U.S. Cl.
CPC ..... *B22F 3/11* (2013.01); *B22F 3/105* (2013.01); *C22C 1/08* (2013.01); *B22F 2003/1053* (2013.01); *B22F 2998/10* (2013.01)

(58) Field of Classification Search
CPC ..... C22C 19/002; C22C 19/03; B22F 3/1125–2003/1131; B22F 3/11; B22F 3/105
See application file for complete search history.

(56) References Cited

U.S. PATENT DOCUMENTS 3,408,180 A * 10/1968 Winkler ..... B01D 39/2093 264/44
3,577,226 A * 5/1971 Elbert et al. ..... F28F 13/187 75/243

(Continued)

FOREIGN PATENT DOCUMENTS

CN 1946500 4/2007
CN 104588651 5/2015

(Continued)

OTHER PUBLICATIONS

SteelJIS; "SUS316 Stainless Steel Composition", retrieved from internet on Mar. 4, 2022; http://steeljis.com/jis_steel_datasheet.php?name_id=75 (Year: 2022).*

(Continued)

*Primary Examiner* — Alexandra M Moore
*Assistant Examiner* — Austin Pollock
(74) *Attorney, Agent, or Firm* — SALIWANCHIK, LLOYD & EISENSCHENK

(57) ABSTRACT

The present application provides a method for manufacturing a metal alloy foam. The present application can provide a method for manufacturing a metal alloy foam, which is capable of forming a metal alloy foam comprising uniformly formed pores and having excellent mechanical properties as well as the desired porosity, and a metal alloy foam having the above characteristics. In addition, the present application can provide a method capable of forming a metal alloy foam in which the above-mentioned physical properties are (Continued)

ensured, while being in the form of a thin film or sheet, within a fast process time, and such a metal alloy foam.

16 Claims, 1 Drawing Sheet

(56) References Cited

U.S. PATENT DOCUMENTS

| | | | | | |
|---|---|---|---|---|---|
| 3,897,221 | A * | 7/1975 | Salyer | C08G 18/5021 521/64 | |
| 5,343,023 | A * | 8/1994 | Geissler | H05B 6/06 219/661 | |
| 5,848,351 | A * | 12/1998 | Hoshino | B22F 3/1125 428/553 | |
| 6,166,360 | A * | 12/2000 | Ruffini, Sr. | C21D 9/0068 219/601 | |
| 6,706,239 | B2 * | 3/2004 | Haack | B22F 3/1137 419/8 | |
| 7,306,753 | B2 | 12/2007 | Kuhstoss et al. | | |
| 2006/0118984 | A1 * | 6/2006 | Farber | B22F 3/1125 264/44 | |
| 2006/0211802 | A1 * | 9/2006 | Asgari | B22F 7/004 524/439 | |
| 2008/0213611 | A1 * | 9/2008 | Asgari | B22F 3/1121 264/44 | |
| 2011/0020662 | A1 | 1/2011 | Okamoto et al. | | |
| 2011/0155662 | A1 * | 6/2011 | Liu | B01D 69/06 264/43 | |
| 2017/0333992 | A1 | 11/2017 | Gao et al. | | |
| 2019/0044159 | A1 * | 2/2019 | Miyamoto | C22C 13/00 | |

FOREIGN PATENT DOCUMENTS

| | | | | |
|---|---|---|---|---|
| DE | 3015981 | A * | 11/1981 | B22F 3/105 |
| EP | 765704 | A2 * | 4/1997 | B01D 39/2051 |
| JP | 05230799 | | 9/1993 | |
| JP | H05230779 | | 9/1993 | |
| JP | 05339605 | | 12/1993 | |
| JP | H06287608 | | 10/1994 | |
| JP | H0949001 | | 2/1997 | |
| JP | 09087705 | | 3/1997 | |
| JP | 2003526006 | | 9/2003 | |
| JP | 2005290494 | A * | 10/2005 | |
| JP | 2005336539 | A | 12/2005 | |
| JP | 2009102701 | | 5/2009 | |
| JP | 5713889 | | 5/2015 | |
| KR | 1020080044344 | | 5/2008 | |
| KR | 1020060134220 | | 6/2008 | |
| KR | 1020110122275 | | 11/2011 | |
| KR | 1020150055901 | | 5/2015 | |
| WO | WO-9837261 | A1 * | 8/1998 | C25D 5/56 |
| WO | 2016066140 | A1 | 5/2016 | |

OTHER PUBLICATIONS

Craig C.H., et al.; "Mechanical properties and microstructure of platinum enhanced radiopaque stainless steel (PERSS) alloys"; J. of Alloys and Compound; 361, 2003, p. 187-199 (Year: 2003).*

International Search Report with English language translation of the International Searching Authority corresponding to International Patent Application No. PCT/KR2017/011233 dated Jan. 11, 2018. (5 pages).

European Office Action corresponding to EP 17860413.8; dated May 28, 2021 (10 pages).

Hermel, W. , et al., "Review of induction sintering: fundamentals and applications", Powder Metallurgy 23(3), 1980, 130-135.

Extended European Search Report corresponding to EP17860413.8, dated Sep. 18, 2019 (8 pages).

* cited by examiner

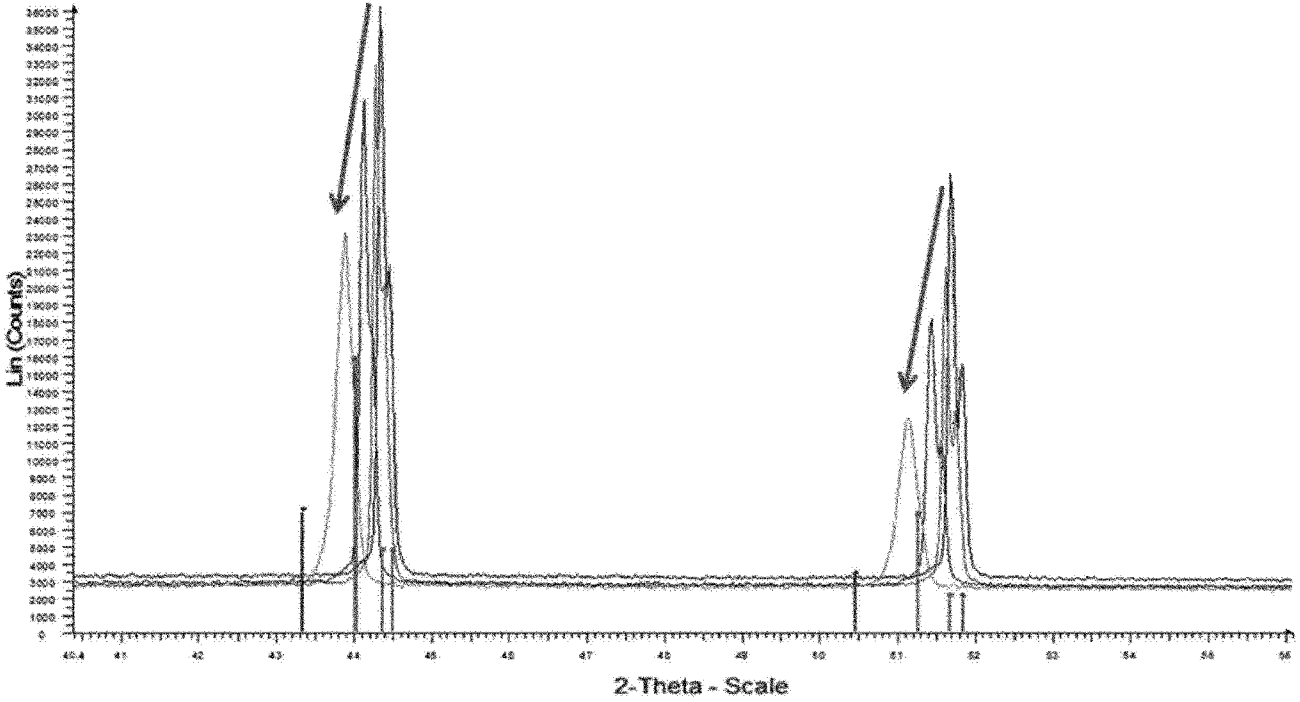
Lin (Counts)
2-Theta - Scale

METHOD FOR MANUFACTURING METAL ALLOY FOAM

CROSS REFERENCE TO RELATED APPLICATIONS

This application is a 35 U.S.C. § 371 national stage application of PCT International Application No. PCT/KR2017/011233, filed on Oct. 12, 2017, which claims priority from Korean Patent Application No. 10-2016-0133353 filed on Oct. 14, 2016, the contents of which are incorporated herein by reference in their entireties. The above reference PCT International Application was published in the Korean language as International Publication No. WO 2018/070795 A1 on Apr. 19, 2018.

Technical Field

This application relates to a method for manufacturing a metal alloy foam and a metal alloy foam.

BACKGROUND ART

Metal foams can be applied to various fields including lightweight structures, transportation machines, building materials or energy absorbing devices, and the like by having various and useful properties such as lightweight properties, energy absorbing properties, heat insulating properties, refractoriness or environment-friendliness. In addition, metal alloy foams not only have a high specific surface area, but also can further improve the flow of fluids, such as liquids and gases, or electrons, and thus can also be usefully used by being applied in a substrate for a heat exchanger, a catalyst, a sensor, an actuator, a secondary battery, a gas diffusion layer (GDL) or a microfluidic flow controller, and the like.

DISCLOSURE

Technical Problem

It is an object of the present invention to provide a method capable of manufacturing a metal alloy foam comprising pores uniformly formed and having excellent mechanical strength as well as a desired porosity.

Technical Solution

In the present application, the term metal alloy foam or metal skeleton means a porous structure comprising two or more metals as a main component. Here, the metal as a main component means that the proportion of the metal is 55 wt % or more, 60 wt % or more, 65 wt % or more, 70 wt % or more, 75 wt % or more, 80 wt % or more, 85 wt % or more, 90 wt % or more, or 95 wt % or more based on the total weight of the metal alloy foam or the metal skeleton. The upper limit of the proportion of the metal contained as the main component is not particularly limited and may be, for example, 100 wt %.

In the present application, the term porous property may mean a case where porosity is 30% or more, 40% or more, 50% or more, 60% or more, 70% or more, 75% or more, or 80% or more. The upper limit of the porosity is not particularly limited, and may be, for example, less than about 100%, about 99% or less, or about 98% or less or so. Here, the porosity can be calculated in a known manner by calculating the density of the metal alloy foam or the like.

The method for manufacturing a metal alloy foam of the present application may comprise a step of sintering a green structure comprising a metal component containing at least two metals. In the present application, the term green structure means a structure before the process performed to form the metal alloy foam, such as the sintering process, that is, a structure before the metal alloy foam is formed. In addition, even when the green structure is referred to as a porous green structure, the structure is not necessarily porous per se, and may be referred to as a porous green structure for convenience, if it can finally form a metal alloy foam, which is a porous metal structure.

In the present application, the green structure may be formed by comprising a metal component containing a first metal and a second metal different from the first metal.

In one example, a metal having an appropriate relative magnetic permeability and conductivity may be applied to the first metal. According to one example of the present application, the application of such a metal can ensure that when an induction heating method to be described below is applied as the sintering, the sintering according to the relevant method is smoothly carried out.

For example, as the first metal, a metal having a relative magnetic permeability of 90 or more may be used. Here, the relative magnetic permeability ($\mu r$) is a ratio ($\mu/\mu_0$) of the magnetic permeability ($\mu$) of the relevant material to the magnetic permeability ($\mu_0$) in the vacuum. The first metal used in the present application may have a relative magnetic permeability of 95 or more, 100 or more, 110 or more, 120 or more, 130 or more, 140 or more, 150 or more, 160 or more, 170 or more, 180 or more, 190 or more, 200 or more, 210 or more, 220 or more, 230 or more, 240 or more, 250 or more, 260 or more, 270 or more, 280 or more, 290 or more, 300 or more, 310 or more, 320 or more, 330 or more, 340 or more, 350 or more, 360 or more, 370 or more, 380 or more, 390 or more, 400 or more, 410 or more, 420 or more, 430 or more, 440 or more, 450 or more, 460 or more, 470 or more, 480 or more, 490 or more, 500 or more, 510 or more, 520 or more, 530 or more, 540 or more, 550 or more, 560 or more, 570 or more, 580 or more, or 590 or more. The upper limit of the relative magnetic permeability is not particularly limited because the higher the value is, the higher the heat is generated when the electromagnetic field for induction heating as described below is applied. In one example, the upper limit of the relative magnetic permeability may be, for example, about 300,000 or less.

The first metal may be a conductive metal. In the present application, the term conductive metal may mean a metal having a conductivity at 20° C. of about 8 MS/m or more, 9 MS/m or more, 10 MS/m or more, 11 MS/m or more, 12 MS/m or more, 13 MS/m or more, or 14.5 MS/m, or an alloy thereof. The upper limit of the conductivity is not particularly limited, and for example, may be about 30 MS/m or less, 25 MS/m or less, or 20 MS/m or less.

In the present application, the first metal having the relative magnetic permeability and conductivity as above may also be simply referred to as a conductive magnetic metal.

By applying the first metal having the relative magnetic permeability and conductivity as above, sintering can be more effectively performed when the induction heating process to be described below proceeds. Such a first metal can be exemplified by nickel, iron or cobalt, and the like, but is not limited thereto.

The metal component may comprise a second metal different from the first metal together with the first metal, whereby a metal alloy foam may be finally formed. As the second metal, a metal having the relative magnetic permeability and/or conductivity in the same range as the above-mentioned first metal may also be used, and a metal having the relative magnetic permeability and/or conductivity outside the range may be used. In addition, the second metal may also comprise one or two or more metals. The kind of the second metal is not particularly limited as long as it is different from the first metal, and for example, one or more metals, different from the first metal, of copper, phosphorus, molybdenum, zinc, manganese, chromium, indium, tin, silver, platinum, gold, aluminum or magnesium, and the like may be applied, without being limited thereto.

The ratio of the first and second metals in the metal component is not particularly limited. For example, the ratio of the first metal may be adjusted so that the first metal may generate an appropriate Joule heat upon application of the induction heating method to be described below. For example, the metal component may comprise 30 wt % or more of the first metal based on the weight of the total metal component. In another example, the ratio of the first metal in the metal component may be about 35 wt % or more, about 40 wt % or more, about 45 wt % or more, about 50 wt % or more, about 55 wt % or more, 60 wt % or more, 65 wt % or more, 70 wt % or more, 75 wt % or more, 80 wt % or more, 85 wt % or more, or 90 wt % or more. The upper limit of the first metal ratio is not particularly limited, and may be, for example, less than about 100 wt %, or 95 wt % or less. However, the above ratios are exemplary ratios. For example, since the heat generated by induction heating due to application of an electromagnetic field can be adjusted according to the strength of the electromagnetic field applied, the electrical conductivity and resistance of the metal, and the like, the ratio can be changed depending on specific conditions.

The metal component forming the green structure may be in the form of powder. For example, the metals in the metal component may have an average particle diameter in a range of about 0.1 μm to about 200 μm. In another example, the average particle diameter may be about 0.5 μm or more, about 1 μm or more, about 2 μm or more, about 3 μm or more, about 4 μm or more, about 5 μm or more, about 6 μm or more, about 7 μm or more, or about 8 μm or more. In another example, the average particle diameter may be about 150 μm or less, 100 μm or less, 90 μm or less, 80 μm or less, 70 μm or less, 60 μm or less, 50 μm or less, 40 μm or less, 30 μm or less, or 20 μm or less. As the first and second metals, those having different average particle diameters may also be applied. The average particle diameter can be selected from an appropriate range in consideration of the shape of the desired metal alloy foam, for example, the thickness or porosity of the metal alloy foam, and the like, which is not particularly limited.

The green structure may be formed using a slurry comprising a dispersant and a binder together with the metal component comprising the first and second metals.

The component used as the dispersant is not particularly limited, and for example, an alcohol may be applied. As the alcohol, a monohydric alcohol having 1 to 20 carbon atoms such as methanol, ethanol, propanol, pentanol, octanol, 2-methoxyethanol, 2-ethoxyethanol, 2-butoxyethanol, texanol, or terpineol, or a dihydric alcohol having 1 to 20 carbon atoms such as ethylene glycol, propylene glycol, hexane diol, octane diol or pentane diol, or a polyhydric alcohol, etc., may be used, but the kind is not limited to the above.

The ratio of the dispersant in the slurry is not particularly limited, which may be selected in consideration of dispersibility and the like, and for example, the dispersant may be present in the slurry at a ratio of about 10 to 500 parts by weight relative to 100 parts by weight of the metal component, but is not limited thereto. In another example, the ratio may be about 15 parts by weight or more, about 20 parts by weight or more, or about 25 parts by weight or more. Also, the ratio may be, for example, about 450 parts by weight or less, about 400 parts by weight or less, about 350 parts by weight or less, about 300 parts by weight or less, about 250 parts by weight or less, about 200 parts by weight or less, about 150 parts by weight or less, about 100 parts by weight or less, or about 50 parts by weight or less.

The slurry may further comprise a binder if necessary. The kind of the binder is not particularly limited, and may be appropriately selected depending on the kind of the metal component, the dispersant or the solvent, and the like applied at the time of producing the slurry. For example, the binder may be exemplified by alkyl cellulose having an alkyl group having 1 to 8 carbon atoms such as methyl cellulose or ethyl cellulose, polyalkylene carbonate having an alkylene unit having 1 to 8 carbon atoms such as polypropylene carbonate or polyethylene carbonate, or a polyvinyl alcohol-based binder such as polyvinyl alcohol or polyvinyl acetate, and the like, but is not limited thereto.

The binder may be present in the slurry at a ratio of about 5 to 200 parts by weight relative to 100 parts by weight of the metal component, but is not limited thereto. That is, the ratio may be controlled in consideration of the desired viscosity of the slurry, maintenance efficiency by the binder, and the like. In another example, the ratio may be about 10 parts by weight or more, about 20 parts by weight or more, about 30 parts by weight or more, about 40 parts by weight or more, about 50 parts by weight or more, about 60 parts by weight or more, about 70 parts by weight or more, about 80 parts by weight or more, or about 90 parts by weight or more. The ratio may be, for example, about 190 parts by weight or less, about 180 parts by weight or less, about 170 parts by weight or less, about 160 parts by weight or less, about 150 parts by weight or less, about 140 parts by weight or less, about 130 parts by weight or less, 120 parts by weight or less, or about 110 parts by weight or less.

The binder may be present in the slurry at a ratio of about 3 to 500 parts by weight relative to 100 parts by weight of the dispersant, but is not limited thereto. That is, the ratio may be controlled in consideration of the desired dispersion degree, the viscosity of the slurry, the maintenance efficiency by the binder, and the like. In another example, the ratio is about 10 parts by weight or more, about 20 parts by weight or more, about 30 parts by weight or more, about 40 parts by weight or more, about 50 parts by weight or more, about 60 parts by weight or more, about 70 parts by weight or more, about 80 parts by weight or more, about 90 parts by weight or more, about 100 parts by weight or more, about 150 parts by weight or more, about 200 parts by weight or more, or about 250 parts by weight or more. The ratio may be, for example, about 450 parts by weight or less, about 400 parts by weight or less, about 350 parts by weight or less, about 300 parts by weight or less, about 250 parts by weight or less, about 200 parts by weight or less, about 150 parts by weight or less, about 100 parts by weight or less, or about 50 parts by weight or less.

The slurry may further comprise a solvent, if necessary. As the solvent, an appropriate solvent may be used in consideration of solubility of the slurry component, for example, the metal component or a polymer powder, and the like. For example, as the solvent, those having a dielectric constant within a range of about 10 to 120 can be used. In another example, the dielectric constant may be about 20 or more, about 30 or more, about 40 or more, about 50 or more, about 60 or more, or about 70 or more, or may be about 110 or less, about 100 or less, or about 90 or less. Such a solvent may be exemplified by water, an alcohol having 1 to 8 carbon atoms such as ethanol, butanol or methanol, DMSO (dimethyl sulfoxide), DMF (dimethyl formamide) or NMP (N-methylpyrrolidinone), and the like, but is not limited thereto.

The solvent may be present in the slurry at a ratio of about 1 to 100 parts by weight relative to 100 parts by weight of the metal component, but is not limited thereto.

The slurry may also comprise, in addition to the above-mentioned components, known additives which are additionally required.

The method of forming the green structure using the slurry as above is not particularly limited. In the field of manufacturing metal foams, various methods for forming the green structure are known, and in the present application all of these methods can be applied. For example, the green structure may be formed by holding the slurry in an appropriate template, or by coating the slurry in an appropriate manner.

The shape of such a green structure is not particularly limited as it is determined depending on the desired metal alloy foam. In one example, the green structure may be in the form of a film or sheet. For example, when the structure is in the form of a film or sheet, the thickness may be 2,000 μm or less, 1,500 μm or less, 1,000 μm or less, 900 μm or less, 800 μm or less, 700 μm or less, 600 μm or less, 500 μm or less, 400 μm or less, 300 μm or less, 200 μm or less, 150 μm or less, about 100 μm or less, about 90 μm or less, about 80 μm or less, about 70 μm or less, about 60 μm or less, or about 55 μm or less. Metal alloy foams have generally brittle characteristics due to their porous structural features, so that there are problems that they are difficult to be manufactured in the form of films or sheets, particularly thin films or sheets, and are easily broken even when they are made. However, according to the method of the present application, it is possible to form a metal alloy foam having pores uniformly formed inside and excellent mechanical properties as well as a thin thickness. The lower limit of the structure thickness is not particularly limited. For example, the film or sheet shaped structure may have a thickness of about 10 μm or more, 20 μm or more, or about 30 μm or more.

The metal alloy foam can be manufactured by sintering the green structure formed in the above manner. In this case, a method of performing the sintering for producing the metal alloy foam is not particularly limited, and a known sintering method can be applied. That is, the sintering can proceed by a method of applying an appropriate amount of heat to the green structure in an appropriate manner.

As a method different from the existing known method, in the present application, the sintering can be performed by an induction heating method. That is, as described above, the metal component comprises the first metal having the predetermined magnetic permeability and conductivity, and thus the induction heating method can be applied. By such a method, it is possible to smoothly manufacture metal alloy foams having excellent mechanical properties and whose porosity is controlled to the desired level as well as comprising uniformly formed pores.

Here, the induction heating is a phenomenon in which heat is generated from a specific metal when an electromagnetic field is applied. For example, if an electromagnetic field is applied to a metal having a proper conductivity and magnetic permeability, eddy currents are generated in the metal, and Joule heating occurs due to the resistance of the metal. In the present application, a sintering process through such a phenomenon can be performed. In the present application, the sintering of the metal alloy foam can be performed in a short time by applying such a method, thereby ensuring the processability, and at the same time, the metal alloy foam having excellent mechanical strength as well as being in the form of a thin film having a high porosity can be produced.

Thus, the sintering process may comprise a step of applying an electromagnetic field to the green structure. By the application of the electromagnetic field, Joule heat is generated by the induction heating phenomenon in the first metal of the metal component, whereby the structure can be sintered. At this time, the conditions for applying the electromagnetic field are not particularly limited as they are determined depending on the kind and ratio of the first metal in the green structure, and the like. For example, the induction heating can be performed using an induction heater formed in the form of a coil or the like. In addition, the induction heating can be performed, for example, by applying a current of 100 A to 1,000 A or so. In another example, the applied current may have a magnitude of 900 A or less, 800 A or less, 700 A or less, 600 A or less, 500 A or less, or 400 A or less. In another example, the current may have a magnitude of about 150 A or more, about 200 A or more, or about 250 A or more.

The induction heating can be performed, for example, at a frequency of about 100 kHz to 1,000 kHz. In another example, the frequency may be 900 kHz or less, 800 kHz or less, 700 kHz or less, 600 kHz or less, 500 kHz or less, or 450 kHz or less. In another example, the frequency may be about 150 kHz or more, about 200 kHz or more, or about 250 kHz or more.

The application of the electromagnetic field for the induction heating can be performed within a range of, for example, about 1 minute to 10 hours. In another example, the application time may be about 9 hours or less, about 8 hours or less, about 7 hours or less, about 6 hours or less, about 5 hours or less, about 4 hours or less, about 3 hours or less, about 2 hours or less, about 1 hour or less, or about 30 minutes or less.

The above-mentioned induction heating conditions, for example, the applied current, the frequency and the application time, and the like may be changed in consideration of the kind and the ratio of the conductive magnetic metal, as described above.

The sintering of the green structure may be carried out only by the above-mentioned induction heating, or may also be carried out by applying an appropriate heat, together with the induction heating, that is, the application of the electromagnetic field, if necessary.

The present application also relates to a metal alloy foam. The metal alloy foam may be one manufactured by the above-mentioned method. Such a metal alloy foam may comprise, for example, at least the above-described first metal. The metal alloy foam may comprise, on the basis of weight, 30 wt % or more, 35 wt % or more, 40 wt % or more, 45 wt % or more, or 50 wt % or more of the first metal. In another example, the ratio of the first metal in the metal alloy foam may be about 55 wt % or more, 60 wt % or more, 65 wt % or more, 70 wt % or more, 75 wt % or more, 80 wt % or more, 85 wt % or more, or 90 wt % or more. The upper limit of the ratio of the first metal is not particularly limited, and may be, for example, less than about 100 wt % or 95 wt % or less.

The metal alloy foam may have a porosity in a range of about 40% to 99%. As mentioned above, according to the method of the present application, porosity and mechanical strength can be controlled, while comprising uniformly formed pores. The porosity may be 50% or more, 60% or more, 70% or more, 75% or more, or 80% or more, or may be 95% or less, or 90% or less.

The metal alloy foam may also be present in the form of thin films or sheets. In one example, the metal alloy foam may be in the form of a film or sheet. The metal alloy foam of such a film or sheet form may have a thickness of 2,000 μm or less, 1,500 μm or less, 1,000 μm or less, 900 μm or less, 800 μm or less, 700 μm or less, 600 μm or less, 500 μm or less, 400 μm or less, 300 μm or less, 200 μm or less, 150 μm or less, about 100 μm or less, about 90 μm or less, about 80 μm or less, about 70 μm or less, about 60 μm or less, or about 55 μm or less. For example, the film or sheet shaped metal alloy foam may have a thickness of about 10 μm or more, about 20 μm or more, about 30 μm or more, about 40 μm or more, about 50 μm or more, about 100 μm or more, about 150 μm or more, about 200 μm or more, about 250 μm or more, about 300 μm or more, about 350 μm or more, about 400 μm or more, about 450 μm or more, or about 500 μm or more.

The metal alloy foam may have excellent mechanical strength, and for example, may have a tensile strength of 2.5 MPa or more, 3 MPa or more, 3.5 MPa or more, 4 MPa or more, 4.5 MPa or more, or 5 MPa or more. Also, the tensile strength may be about 10 MPa or more, about 9 MPa or more, about 8 MPa or more, about 7 MPa or more, or about 6 MPa or less. Such a tensile strength can be measured, for example, by KS B 5521 at room temperature.

Such metal alloy foams can be utilized in various applications where a porous metal structure is required. In particular, according to the method of the present application, it is possible to manufacture a thin film or sheet shaped metal alloy foam having excellent mechanical strength as well as the desired level of porosity, as described above, thus expanding applications of the metal alloy foam as compared to the conventional metal alloy foam.

Advantageous Effects

The present application can provide a method for manufacturing a metal alloy foam, which is capable of forming a metal alloy foam comprising uniformly formed pores and having excellent mechanical properties as well as the desired porosity, and a metal alloy foam having the above characteristics. In addition, the present application can provide a method capable of forming a metal alloy foam in which the above-mentioned physical properties are ensured, while being in the form of a thin film or sheet, and such a metal alloy foam.

BRIEF DESCRIPTION OF DRAWINGS

FIG. 1 is the XRD analysis results of a metal alloy formed in Example.

MODE FOR INVENTION

Hereinafter, the present application will be described in detail by way of examples and comparative examples, but the scope of the present application is not limited to the following examples.

Example 1

Nickel (Ni) having a conductivity of about 14.5 MS/m at 20° C. and a relative magnetic permeability of about 600 was used as a first metal and copper (Cu) was used as a second metal, and the first metal and the second metal were mixed in a weight ratio (Ni:Cu) of about 99:1 to form a metal component. Here, the average particle diameter of nickel as the first metal was about 10 μm or so, and the average particle diameter of copper was about 5 μm or so. The metal component, texanol as a dispersant and ethyl cellulose as a binder were mixed in a weight ratio of 50:15:50 (metal component:dispersant:binder) to prepare a slurry. The slurry was coated on a quartz plate in the form of a film to form a green structure. Subsequently, the green structure was dried at a temperature of about 120° C. for about 60 minutes. An electromagnetic field was then applied to the green structure with a coil-type induction heater while purging with hydrogen/argon gas to form a reducing atmosphere. The electromagnetic field was formed by applying a current of about 350 A at a frequency of about 380 kHz, and the electromagnetic field was applied for about 5 minutes. After the application of the electromagnetic field, the sintered green structure was placed in water and subjected to sonication cleaning to produce a nickel-copper alloy sheet having a thickness of about 39 μm in the form of a film. The produced nickel-copper sheet had a porosity of about 80.3% and a tensile strength of about 4.3 MPa. FIG. 1 is XRD data of the alloy produced in Example. It can be seen from the drawing that peaks of XRD have been shifted from peaks of Ni alone to alloy peaks of Ni and Cu (shifting in the direction of arrow in FIG. 1), whereby it can be seen that the alloy has been formed.

Example 2

A nickel-copper alloy sheet having a thickness of about 38 μm in the form of a film was produced in the same manner as in Example 1, except that the weight ratio (Ni:Cu) of the first and second metals in the metal component was changed to 97:3. The produced nickel-copper alloy sheet had a porosity of about 79.9% and a tensile strength of about 5.4 MPa.

Example 3

A nickel-copper alloy sheet having a thickness of about 40 μm in the form of a film was produced in the same manner as in Example 1, except that the weight ratio (Ni:Cu) of the first and second metals in the metal component was changed to 95:5. The produced nickel-copper alloy sheet had a porosity of about 80.5% and a tensile strength of about 5.3 MPa.

Example 4

A nickel-copper alloy sheet having a thickness of about 45 μm in the form of a film was produced in the same manner as in Example 1, except that the weight ratio (Ni:Cu) of the first and second metals in the metal component was changed to 9:1. The produced nickel-copper alloy sheet had a porosity of about 79.5% and a tensile strength of about 5.4 MPa.

Example 5

A nickel-copper alloy sheet having a thickness of about 38 μm in the form of a film was produced in the same manner as in Example 1, except that the weight ratio (Ni:Cu) of the first and second metals in the metal component was changed to 8:2. The produced nickel-copper alloy sheet had a porosity of about 79.1% and a tensile strength of about 5.4 MPa.

Example 6

A nickel-copper alloy sheet having a thickness of about 38 μm in the form of a film was produced in the same manner as in Example 1, except that the weight ratio (Ni:Cu) of the first and second metals in the metal component was changed to 1:1. The produced nickel-copper alloy sheet had a porosity of about 79.5% and a tensile strength of about 5.2 MPa.

Reference Example

A nickel-copper alloy sheet having a thickness of about 44 μm in the form of a film was produced in the same manner as in Example 1, except that only nickel as the first metal in the metal component was applied. The produced nickel sheet had a porosity of about 81.5% and a tensile strength of about 4.2 MPa.

What is claimed is:

1. A method for manufacturing a metal alloy foam, comprising:

sintering a green structure comprising a metal component, wherein the green structure is formed by using a slurry comprising the metal component, a dispersant and a binder, wherein the metal component comprises a first metal having a relative magnetic permeability of 90 or more and a conductivity at 20° C. of 8 MS/m or more and a second metal different from the first metal, wherein the metal component comprises 30 weight % or more of the first metal based on the total weight of the metal component, wherein the second metal is one or more selected from the group consisting of copper, zinc, indium, tin, silver, platinum, gold, aluminum and magnesium, wherein the slurry comprises 20 to 500 parts by weight of the dispersant relative to 100 parts by weight of the metal component, wherein the slurry comprises 30 to 200 parts by weight of the binder relative to 100 parts by weight of the metal component, wherein the slurry comprises 3 to 400 parts by weight of the binder relative to 100 parts by weight of the dispersant, wherein the dispersant is a monohydric alcohol having 1 to 20 carbon atoms selected from the group consisting of methanol, ethanol, propanol, pentanol, octanol, 2-methoxyethanol, 2-ethoxyethanol, 2-butoxyethanol, texanol, and terpineol, wherein the green structure is formed by coating the slurry in the form of a film or sheet having a thickness of 2,000 μm or less, wherein the sintering of the green structure is performed only by applying an electromagnetic field to the structure, and wherein the electromagnetic field is formed by applying a current in a range of 250 A to 1,000 A.

2. The method for manufacturing a metal alloy foam according to claim 1, wherein the first metal is nickel, iron or cobalt.

3. The method for manufacturing a metal alloy foam according to claim 1, wherein the metal component comprises 35 weight % or more of the first metal based on the total weight of the metal component.

4. The method for manufacturing a metal alloy foam according to claim 1, wherein the metal component has an average particle diameter in a range of 0.1 to 200 μm.

5. The method for manufacturing a metal alloy foam according to claim 1, wherein the binder is an alkyl cellulose, polyalkylene carbonate or polyvinyl alcohol compound.

6. The method for manufacturing a metal alloy foam according to claim 1, wherein the slurry comprises 25 to 500 parts by weight of the dispersant relative to 100 parts by weight of the metal component.

7. The method for manufacturing a metal alloy foam according to claim 1, wherein the slurry comprises 40 to 200 parts by weight of the binder relative to 100 parts by weight of the metal component.

8. The method for manufacturing a metal alloy foam according to claim 1, wherein the slurry comprises 3 to 350 parts by weight of the binder relative to 100 parts by weight of the dispersant.

9. The method for manufacturing a metal alloy foam according to claim 1, wherein the electromagnetic field is formed by applying a current in a range of 350 A to 1,000 A.

10. The method for manufacturing a metal alloy foam according to claim 1, wherein the electromagnetic field is formed by applying a current at a frequency in a range of 100 kHz to 1,000 kHz.

11. The method for manufacturing a metal alloy foam according to claim 1, wherein the electromagnetic field is applied for a time in a range of 1 minute to 10 hours.

12. The method for manufacturing a metal alloy foam according to claim 1, wherein the method comprises drying the green structure prior to the sintering.

13. The method for manufacturing a metal alloy foam according to claim 1, wherein the slurry consists of the metal component, the dispersant and the binder.

14. The method for manufacturing a metal alloy foam according to claim 1, wherein the green structure is formed by coating the slurry in the form of a film or sheet having a thickness of 1,000 μm or less.

15. The method for manufacturing a metal alloy foam according to claim 1, wherein the green structure is formed by coating the slurry in the form of a film or sheet having a thickness of 500 μm or less.

16. The method for manufacturing a metal alloy foam according to claim 1, wherein the green structure is formed by coating the slurry in the form of a film or sheet having a thickness of 100 μm or less.

* * * * *